United States Patent [19]

Hudak

[11] Patent Number: 4,580,390

[45] Date of Patent: Apr. 8, 1986

[54] PACKAGING ASSEMBLY

[75] Inventor: Luther D. Hudak, New Egypt, N.J.

[73] Assignee: Carter-Wallace, Inc., New York, N.Y.

[21] Appl. No.: 584,098

[22] Filed: Feb. 27, 1984

[51] Int. Cl.[4] ..... B65B 19/00

[52] U.S. Cl. ..... 53/236; 53/252; 53/253

[58] Field of Search ..... 53/148, 236, 252, 253, 53/444, 522, 575; 198/481, 614, 778; 221/79, 81, 82, 83, 236

[56] References Cited

U.S. PATENT DOCUMENTS

| | | | |
|---|---|---|---|
| 2,753,267 | 7/1956 | Rabin et al. | 53/522 |
| 3,250,213 | 5/1966 | Brigham et al. | 198/481 |
| 3,553,925 | 1/1971 | Gianese | 53/148 |
| 3,772,848 | 11/1973 | Rudszinat et al. | 53/444 |

*Primary Examiner*—James F. Coan

*Attorney, Agent, or Firm*—Carella, Byrne, Bain & Gilfillan

[57] ABSTRACT

There is disclosed a packaging assembly for inserting a plurality of small diameter tubes into a packaging container wherein the assembly is comprised of a container rotor, a tube supply rotor and an injection rotor mounted in keyed relationship on a shaft driven by a motor and wherein the container rotor includes a channel for receiving the packaging container, the supply rotor includes a channel for receiving a preselect quantity of the small diameter tubes and wherein the injection rotor includes a channel for receiving in reciprocating relationship a plurality of rod member and wherein said channels of the rotors are in co-axial alignment with one another whereby a reciprocating movement of the rod member inserts the plurality of small diameter tubes into the packaging container.

3 Claims, 4 Drawing Figures

PACKAGING ASSEMBLY

FIELD OF THE INVENTION

This invention relates to a method and apparatus for packing tubes, and more particularly to a novel apparatus for packing a plurality of tubes, such as capillary tubes, in a container.

BACKGROUND OF THE INVENTION

The packaging of capillary tubes or assemblies has involved the manual counting of a unit number of capillary tubes and thereafter inserting such unit member tubes into a container. Such manual counting and packaging is tedious—leading to counting errors as well as being extremely labor intensive. Additionally, the manual handling of glass tubing leads to injury to the handling personnel.

OBJECTS OF THE INVENTION

An object of the present invention is to provide a novel apparatus for packing a plurality of tubes in a container.

Another object of the present invention is to provide a novel apparatus for packing a plurality of tubes in a container obviating the tedium of prior art practices.

Yet another object of the present invention is to provide a novel apparatus for packing a plurality of tubes in a container reducing likelihood of injury through manual handling of capillary tubes.

SUMMARY OF THE INVENTION

These and other objects of the invention are achieved by a packaging assembly for inserting a plurality of small diameter tubes into a packaging container wherein the assembly is comprised of a container rotor, a tube supply rotor and an injection rotor mounted in keyed relationship on a shaft driven by a motor and wherein the container rotor includes a channel for receiving the packaging container, the supply rotor includes a channel for receiving a preselect quantity of small diameter tubes and wherein the injection rotor includes a channel for receiving in reciprocating relationship a plurality of rod members and wherein said channels of the rotors are in co-axial alignment with one another whereby a reciprocating movement of the rod member inserts the plurality of small diameter tubes into the packaging container.

BRIEF DESCRIPTION OF THE DRAWINGS

These and other objects of the present invention will become manifest by reference to the following detailed description when taken with the accompanying drawings wherein like numerals designate like parts throughout and wherein.

DETAILED DESCRIPTION OF THE DESCRIPTION

Figure 1:
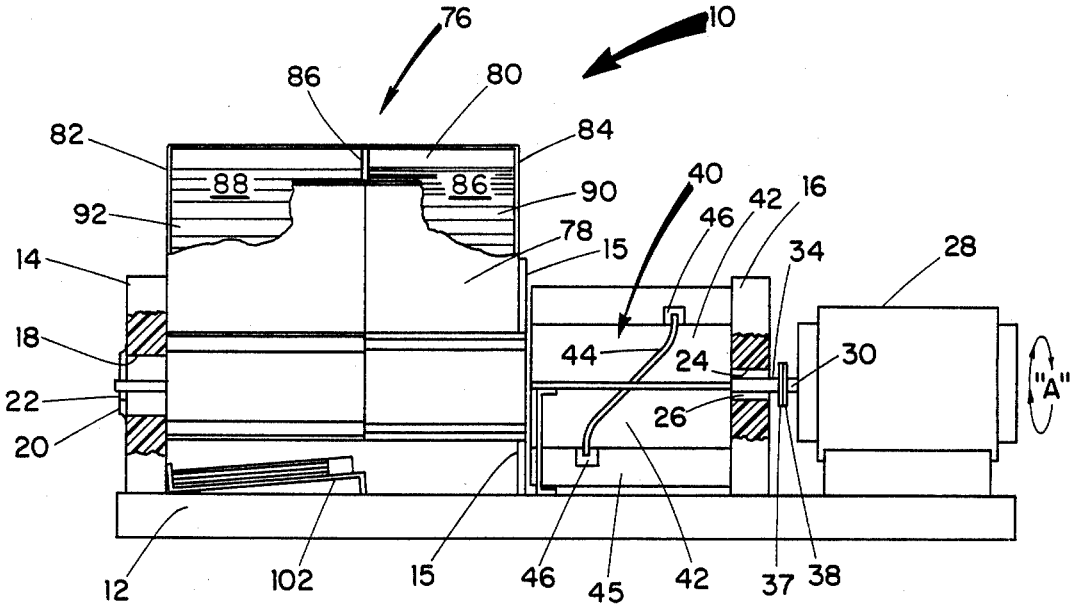
FIG. 1 is an elevational view of the packing assembly of the present invention.

Referring now to the drawing and particular FIG. 1, there is illustrated a rotary packaging assembly, generally indicated as 10, comprised of a base platform 12 disposed on a suitable foundation on which is mounted a vertically-disposed end plate member 14, a vertically-disposed intermediate plate member 15 and a vertically-disposed plate member 16 spaced apart and parallelly-disposed to one another transverse to the base platform 12. The end plate member 14 is formed with a cylindrical opening 18 for receiving a bearing plate member 20 including a bearing 22, mounted to the end plate member 14, such as by bolts members (not shown). The intermediate plate member 16 is formed with a cylindrical opening 24 in which is disposed a bearing member 26.

On a side of the plate member 16 opposite the end plate member 14, there is positioned a motor 28 including a shaft 30 and a coupling element 32 mounted to the base platform 12. The motor 28 is preferably of a DC reversible type having variable speed capabilities. A shaft 34 is laterally-disposed between the end plate member 14 and the plate member 16 in the bearing 22 of the bearing member 20 and the bearing 26, respectively. The shaft 34 includes a key-way 36 (referring to FIG. 4), and is formed with a coupling element 38 affixed to the coupling element 32 of the shaft 30, such as by bolts (not shown).

On a side of the plate member 16 opposite the motor 28, there is mounted a cylindrically-shaped guide member, generally indicated as 40, formed by cooperating half elements 42 defining a sinusoidally-shaped slot 44 co-axially disposed with respect to the shaft 34. Mounting of the half elements 42 forming the cylindrically-shaped guide member 40 is effected by quadrantly-spaced plate elements 45 including slots 46 aligned with respect to the sinusoidally-shaped slot 42.

Figure 2:
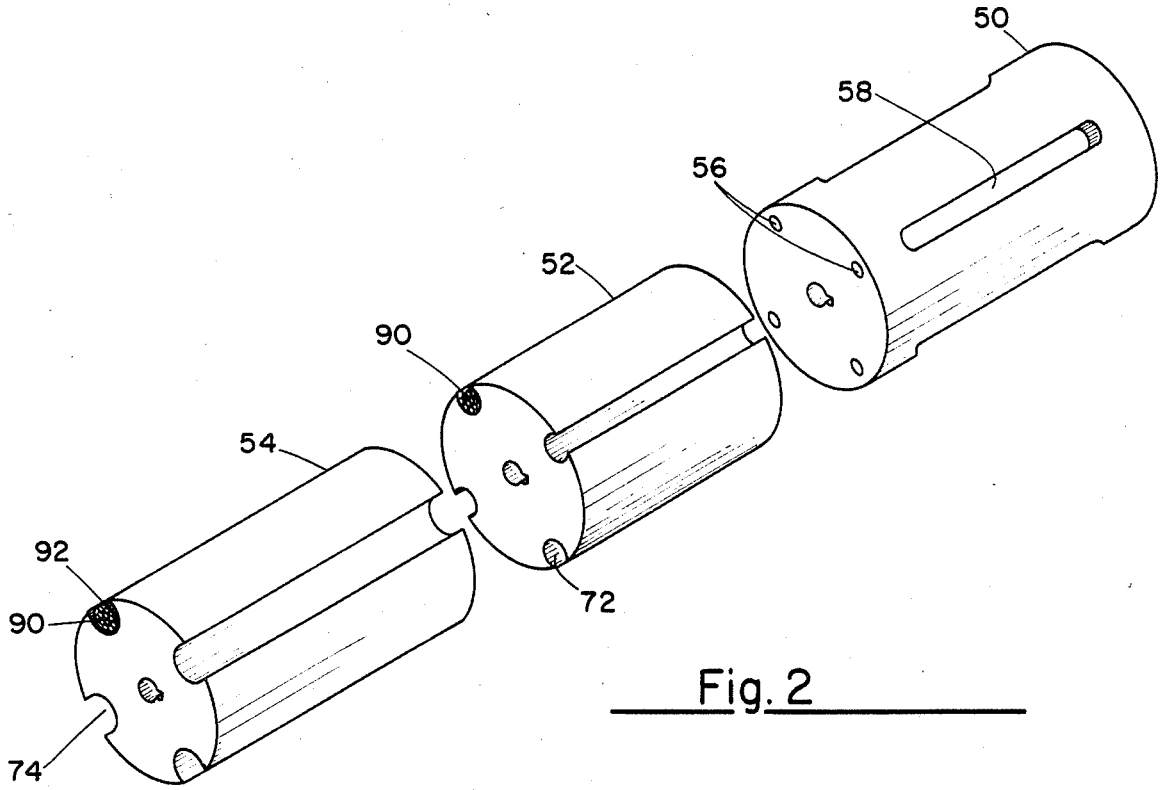
FIG. 2 is an exploded view of the assemblage of the rotors.
Figure 3:
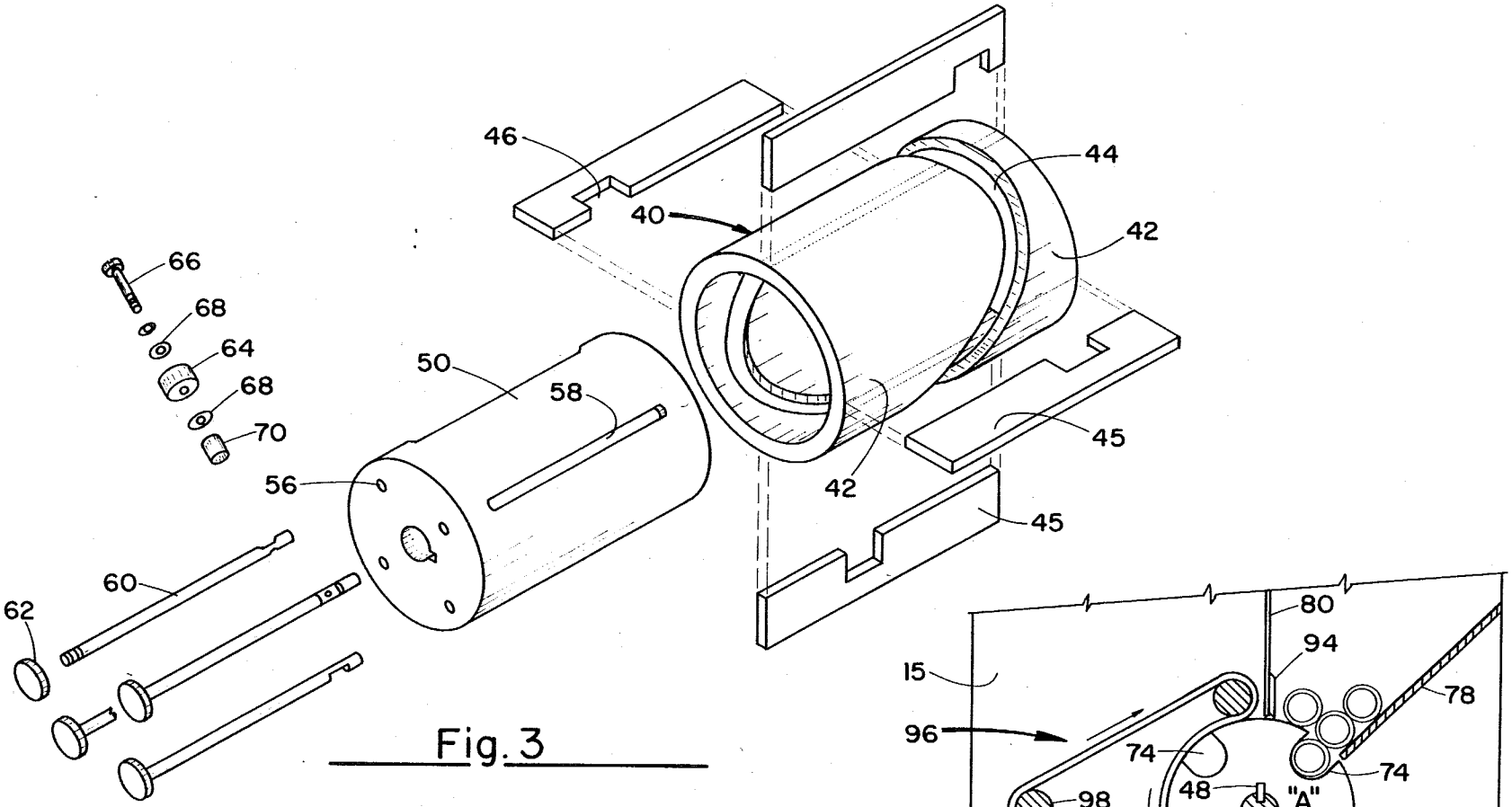
FIG. 3 is an exploded view of the injector rotor assembly of the present invention.

On the shaft 34, there is keyed by key element 48, a cylindrically-shaped injection rotor 50, a cylindrically-shaped capillary rotor 52, and a cylindrically-shaped container rotor 54, respectively, disposed between the intermediate plate member 15 and the end plate member 14, referring particularly to FIG. 2. The injection rotor 50 is formed with a plurality of longitudinally-disposed channels 56 disposed 90° from one another and coaxially with respect to the shaft 34. Radially of the channels 56, there are formed slots 58 extending inwardly to the channels 56. Within each channel 56, referring to FIG. 3, there is disposed for reciprocating movement, a rod member 60 having a disc-shaped cap member 62 threadably disposed thereon and extending from the injection rotor 50 towards the capillary rotor 52. Proximate an end of each rod member 60 opposite the cap member 62, there is provided a roller member 64 spacially mounted for coursing through the sinusoidally-shaped slot 42 formed in the guide member 40, as more fully hereinafter discussed. Each roller member 64 is mounted to each rod member 60, such as by threaded screw 66 including washers 68 and space elements 70.

The capillary rotor 52 is formed with a plurality of cylindrically-shaped chambers 72 disposed longitudinally about a peripheral outer surface thereof and disposed at 90° to one another. The container rotor 54 is formed with a plurality of U-shaped chambers 74 disposed longitudinally about a peripheral outer surface thereof and likewise disposed at 90° to one another. The rotors 50, 52 and 54 are keyed on the shaft 34 by key 48 such that the channels 56, the chambers 72 and the U-shaped chambers 74, respectively, are in co-axially alignment.

Figure 4:
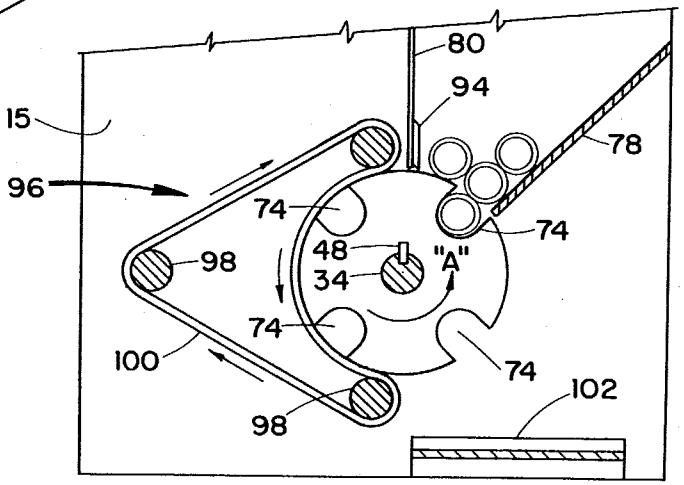
FIG. 4 is a partial side view taken along the lines 4—4 of FIG. 1.

Above the capillary rotor 52 and the container rotor 54, there is disposed a hopper assembly, generally indicated as 76, referring again to FIG. 1, mounted to the end plate member 14 and the plate member 15. The hopper assembly 76 is formed of a front wall 78, a back wall 80, side walls 82 and 84 and an inner intermediate wall member 86 dividing the hopper 76 into a bin 86 and a bin 88 for receiving capillary tubes 90 and packaging containers 92, respectively. The back wall 80, referring particularly to FIG. 4, is provided with an elastomeric blade member 94 for absorbing energy to reduce breakage.

The packaging assembly 10 is provided with a tracking belt assembly, generally indicated as 96, referring again to FIG. 4 comprised of three rollers members 98 mounted to the end wall 14 and plate member 15 and on which is coursed a plurality of endless elastomeric belts 100 for maintaining capillary tubes 90 and packaging containers 92 within the chambers 72 and 74 of the capillary rotor 52 and container rotor 54, respectively. Beneath the bin portion 88 of the packing assembly 10 there is provided a receiving deck 102 mounted on the base 12 for receiving packaging containers 92 filled with capillary tubes 94.

In operation, the capillary tubes 90 and the packaging container 92 are deposited within the bins 86 and 88, respectively. The motor 28 is energized thereby causing the rotor (not shown) of the motor 28 to rotate in a clockwise direction, as indicated by arrow "A", referring particularly to FIG. 1, thereby effecting clockwise rotation of the shaft 30 and thus the shaft 34 coupled thereto (counterclockwise when referring to FIG. 4). Rotation of the shaft 34 causes clockwise rotation of the rotors 50, 52 and 54 keyed on the shaft 34.

Clockwise rotations of the rotor 50 causes the rollers 64 mounted on the rods 60 to course the sinusoidally-formed slot 44 of the guide member 40 thereby resulting in axial reciprocating movement of the respective rod members 60 including pads 62 whereby a rod member 60 is extended into chamber 72 of the supply rotor 52 and subsequently retracted therefrom. As chambers 72 and 74 of the capillary rotor 52 and packaging rotor 54 enter bin sections 86 and 88, respectively, a preselect quantity or number of capillary tubes 90 are caused to be disposed in the chambers 72 whereas a single packaging container 92 is disposed in the chamber 74. It is understood that a preselect number of capillary tubes 90 is deposited in the channel 72 of the capillary rotor 52 and is a function of the diameter of the capillary tubes 90 and the diameter of the chamber 72. Additionally, it will be understood that the packaging containers 92 are generally enclosed at one end with an opened end thereof being disposed towards the capillary tube rotor 52.

After loading of the respective chambers 72 and 74 of the rotors 50 and 52 with capillary tubes 90 and a packaging tube 92, further rotation of the rotors, referring particularly to FIG. 4 cause the tubes 90 and 92 to contact the elastomeric belt 100 and be retained thereby within the respective chambers. As the chambers 72 and 74 reach an uppermost position, the rod member 60 including pad 62 disposed in a channel 56 of the injector rotor 50 and in coaxially alignment with the chambers 72 and 74 of the rotor 52 and 54 is caused to move from right to left (FIG. 1) by coursing of the corresponding roller 64 mounted thereon within the slot 44 of the guide member 40. In accordance with such movement of the rod member 60, the corresponding pad 62 contacts the ends of the capillary tubes 90 to cause the capillary tubes 90 to be inserted into the corresponding packaging tube 92 disposed within the chamber 74 of the packaging rotor 54.

Upon reaching a lower rotating position, the capillary tubes 90 are fully inserted into the packaging tube 92 with retraction of the rod 60 initiated and completed prior to the point where the elastomeric belt 100 leaves contact with at least packaging rotor 52 thereby permitting the filled packaging container 92 to fall by gravity onto the collection plate 102. Periodically, the thus filled packaging containers 92 including a preselect number of capillary tubes 90 are removed from the receiving deck 102 for further processing (not shown).

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention by only limited by the claims and the equivalents thereof.

What is claimed:

1. A packaging assembly for inserting a plurality of tubes into a container therefor, which comprises a motor including a shaft mounted on a foundation;

a generally cylindrical container rotor, a generally cylindrical supply rotor and a generally cylindrical injection rotor mounted on said shaft, said container rotor including a chamber for receiving a container, said supply rotor including a chamber for receiving said plurality of tubes, said injection rotor including a channel for receiving a rod member in reciprocating relationship -therein, said chambers and channel being in coaxial alignment with one another; and means for effecting reciprocal movement of said rod member within said chamber of said supply rotor, said means for effecting reciprocal movement of said rod member including a guide member having a sinusoidally-shaped slot and being disposed about said injection rotor, and said rod member including a roller disposed in said sinusoidally-shaped slot of said guide member whereby rotation of said shaft causes said roller on said rod member to course said sinusoidally-shaped slot thereby to cause said rod member to be inserted and withdrawn from said chamber of said supply rotor; and hopper means disposed above said container rotor and said supply rotor for dispensing a container and said plurality of tubes into respective chambers thereof.

2. The packaging assembly as defined in claim 1 and further including retaining means to retain said container and said plurality of tubes within said respective rotors during insertion of said plurality of tubes into said container.

3. The packaging assembly as defined in claim 2 wherein said retaining means includes an endless belt coursed about a plurality of rollers.

* * * * *